US006029736A

United States Patent [19]

Naik et al.

[11] Patent Number: 6,029,736

[45] Date of Patent: Feb. 29, 2000

[54] REINFORCED QUARTZ CORES FOR DIRECTIONAL SOLIDIFICATION CASTING PROCESSES

[75] Inventors: Rajeev V. Naik, Grafton; John Corrigan, Tabb, both of Va.

[73] Assignee: Howmet Research Corporation, Whitehall, Mich.

[21] Appl. No.: 08/921,096

[22] Filed: Aug. 29, 1997

[51] Int. Cl.[7] ..... B22C 9/10

[52] U.S. Cl. ..... 164/132; 164/367; 164/369; 164/411

[58] Field of Search ..... 164/529, 138, 164/132, 367, 368, 369, 411, 404

[56] References Cited

U.S. PATENT DOCUMENTS

| | | | |
|---|---|---|---|
| 4,532,974 | 8/1985 | Mills et al. | 164/132 |
| 4,637,449 | 1/1987 | Mills et al. | 164/132 |
| 4,905,750 | 3/1990 | Wolf | 164/35 |
| 5,394,933 | 3/1995 | Takayanagi | 164/369 |
| 5,697,418 | 12/1997 | Bardot et al. | 164/28 |

FOREIGN PATENT DOCUMENTS

| | | | |
|---|---|---|---|
| 0373196 | 10/1989 | European Pat. Off. . | |
| 2259845 | 6/1974 | Germany . | |
| 3144960 | 5/1983 | Germany | 164/132 |
| 1455996 | 11/1976 | United Kingdom . | |
| 1549819 | 8/1979 | United Kingdom . | |
| 2102317 | 2/1983 | United Kingdom . | |

*Primary Examiner*—Harold Pyon
*Assistant Examiner*—I.-H. Lin
*Attorney, Agent, or Firm*—Edward J. Timmer

[57] ABSTRACT

A reinforced core for use in metal casting processes, especially directional solidification casting processes, comprises an elongated, thin-walled outer quartz or silica rich tubular member and a carbon base reinforcement disposed in and extending along a length of the tubular member. The carbon base reinforcement can comprise one or more graphite rods cemented together in end-to-end relation or a carbon fiber bundle. The carbon base reinforcement can include an outer carbide surface region by coating or surface reaction.

21 Claims, 7 Drawing Sheets

REINFORCED QUARTZ CORES FOR DIRECTIONAL SOLIDIFICATION CASTING PROCESSES

FIELD OF THE INVENTION

The present invention relates to reinforced quartz tubular cores for use in directional solidification casting processes to form internal features in castings.

BACKGROUND OF THE INVENTION

In conventional investment casting of nickel or cobalt based superalloy turbine blades, quartz cores are almost always used to produce radial cooling air holes or passages in the casting. Quartz cores are used since quartz is relatively cheap, readily formable into thin cores with bends, and is easy to remove from the casting by conventional chemical leaching processes. Quartz cores are ideally suited for the manufacture of equiaxed grain turbine blade castings having cast-in holes where the mold temperature is typcially below 2200 degree F. However, at temperatures greater than 2400 degrees F. for prolonged times, quartz cores tends to lose their shape due to softening of the quartz material. In directional solidification (DS) casting processes where mold temperatures typically range from 2700 to 2850 degrees F., unsupported quartz core tubes distort significantly of their own weight and also are deflected by flow of the molten superalloy melt into the mold. Hence, unreinforced quartz cores are unsuitable for directional solidification (DS) processes to produce columnar and single crystal grain castings.

In the casting of large gas turbine blades, cores are often required to be formed with bends to provide complex air passage. This requires that a core material be deformable enough to be bent to the required shape and rigid enough not to distort at high temperature during casting. These requirements tend to be incompatible with conventional ceramic core materials, such as alumina, zirconia, and the like. For example, strong ceramic core materials, such as alumina or zirconia, are too rigid to be easily bent and are extremely difficult to remove from the casting. On the other hand, more easily deformable, leachable and cheap core materials, such as quartz, are unable to withstand the high temperatures of DS casting processes for prolonged times.

There thus is need for an improved core useful in DS and other casting processes where the core is exposed to relatively high temperatures for prolonged times.

An object of the present invention is to provide an improved core and method of casting using such improved core to meet this need.

SUMMARY OF THE INVENTION

To this end, the present invention provides a reinforced core for use in casting a melt wherein the reinforced core comprises an elongated, thin-walled outer tubular sheath comprising quartz or other silica rich material and a carbon base reinforcement disposed in and extending along a length of the sheath to provide reinforcement at high temperature of a casting process.

In one embodiment of the invention, one or more thin-walled quartz tubular members is/are employed having a wall thickness between about 0.010 inch and about 0.015 inch to reduce distortion or sagging of the tubular member at the high temperature of casting from tube weight and also to facilitate removal of the core via chemical leaching of the tubular member. Multiple quartz tubes of the same or different cross-sectional size (e.g. diameter) can be joined to form the core.

In another embodiment of the invention, the carbon base reinforcement comprises a graphite member, such as a graphite rod. One or more graphite rods of the same or different cross-sectional size can be cemented together in end-to-end relation in the outer quartz sheath. Alternately, the carbon base reinforcement can comprise one or more carbon fibers disposed along a length of the outer quartz tubular member. The carbon base reinforcement can include an outer carbide, oxide, nitride or other refractory compond surface region formed by coating or surface reaction to stiffen the reinforcement.

The present invention provides a method of casting a melt by providing a mold having a mold cavity, disposing an elongated reinforced core of the type described hereabove in the mold cavity, introducing the melt in the mold cavity about the reinforced core, and solidfying the melt.

One embodiment of the method of the invention involves directionally solidifying a nickel or cobalt superalloy melt at high mold temperature for prolonged time to produce a columnar grain or single crystal casting having the core therein. The method can include the further step of removing the reinforced core from the solidified melt by, for example, leaching the outer sheath followed by removal of the carbon base reinforcement.

Another embodiment of the invention involves desensitizing a core prior to use in a ceramic mold by treating a surface of the quartz or silica rich core sheath with acid in a manner to reduce stress-raising surface defects.

The objects and advantages of the present invention will become more readily apparent from the following description taken with the following drawings.

DESRCIPTION OF THE DRAWINGS

FIGS. 1–5 are schematic sectional views of reinforced quartz cores in accordance with different embodiments of the invention.

FIG. 6 is a schematic sectional view of a ceramic investment casting shell mold having reinforced cores therein in accordance with an embodiment of the invention, the mold being disposed on a chill plate that is withdrawn from a casting furnace to produce a directionally solidified casting. FIGS. 6A and 6B are partial sectional views of the lower core tube end slip fit in a ceramic core or quartz tubular elbow embedded in the mold.

DETAILED DESCRIPTION OF THE INVENTION

Figure 1:
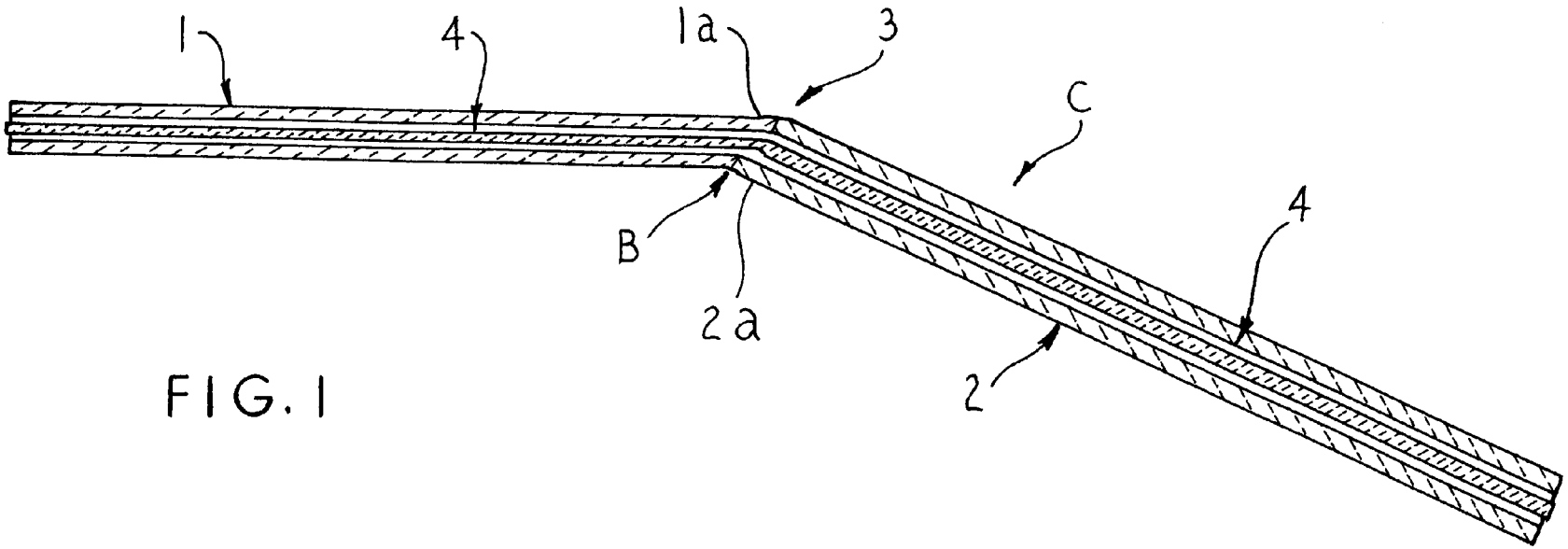

Referring to FIG. 1, a reinforced core C is schematically shown in accordance with one embodiment of the invention as comprising first and second outer quartz cylindrical tube segments or sheaths 1 and 2 preferably having cylindrical internal passages. The tubes 1, 2 can have the same or different outer and inner diameters in the practice the invention. Although the tube segments 1, 2 are shown as cylindrical in shape, the invention is not so limited and other tubular shapes can be used, such as triangular shapes to better fit the trialing edge of a turbine blade airfoil. The outer tube segments or sheaths 1, 2 can have the same lengths or different lengths as required for a given casting. Moreover, although multiple quartz tubes 1, 2 are illustrated, the invention is not so limited and can be practiced using a single quartz tube reinforced as described herebelow. In lieu of quartz sheaths, other silica rich materials can be used as the tube segments or sheaths 1 and 2 in the practice of the invention, such as mullite and other silica rich materials.

Figure 2:
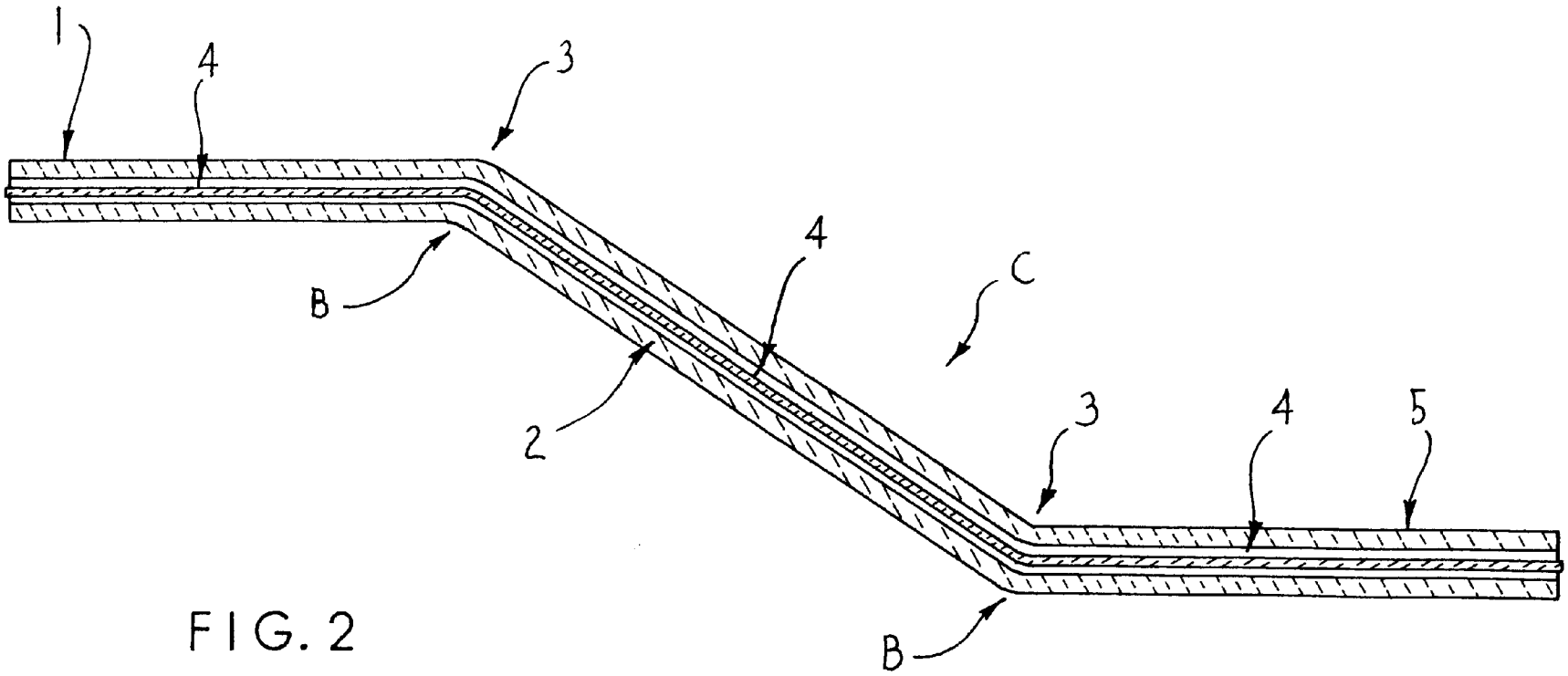
Figure 3:
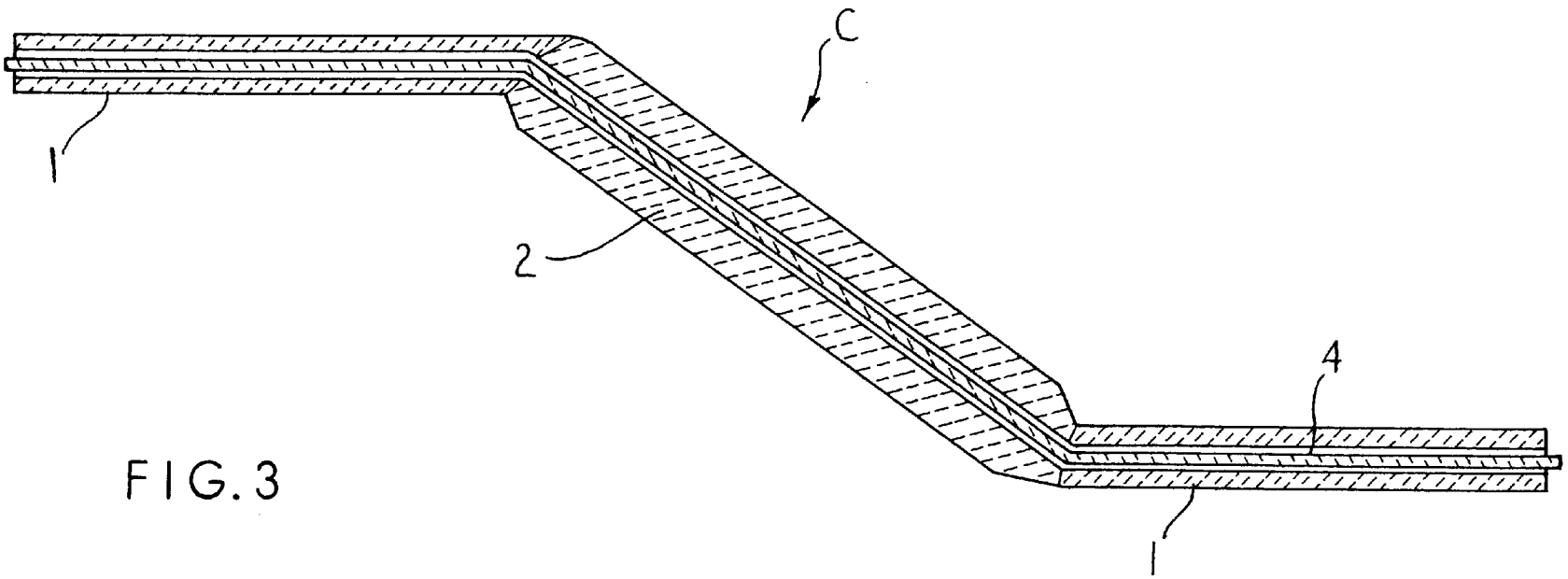

The tube segments or sheaths 1 and 2 are joined together in end-to-end relation in a manner to define a bend B at their junction 3 and maintain a continuation of the internal passages 1*a,* 2*a* through their junction. The tube ends are joined by fusion welding to maintain the continuation of passages 1*a,* 2*a.* FIGS. 2–3 illustrate multiple bends in the reinforced core C having the same or different sized tube segments or sheaths 1, 2. Arcuate quartz tubes 1 and/or 2 can be used in lieu of the straight tubes shown.

The outer tube segments 1, 2 preferably have an extremely thin wall thickness of between about 0.010 inch and about 0.015 inch after desensitizing as described below. Such thin-walled tube segments are advantageous in that a larger carbon based reinforcement relative to the tube can be provided therein and also in that the thin wall reduces sagging or distortion of the tube segments from their own weight and facilitates removal of core by chemical leaching of the outer tube segments 1, 2. Use of the thin-walled quartz tubes 1, 2 is advantageous to provide a larger reinforcment 4 relative to the tube itself. Such thin-walled tube segments or sheaths 1, 2 are commercially available from Industrial Quartz Corporation, Mentor, Ohio.

Prior to use in a ceramic mold, the as-received quartz tube segments or sheaths are desensitized by acid etching by immersing them in (or other contact with) a 25–35 volume % agitated hydrofluoric acid aqueous solution, 15–20 volume % agitated hydrofluoric acid aqueous solution including 5–10 volume % nitric acid, or other suitable dilute acid solution at room temperature to remove up to about 0.005 inch of outer and inner tube wall material in a manner that reduces stress-raising surface defects that may be present on as-received tube stock and loss of tube strength due to presence of such surface defects.

Figure 6:
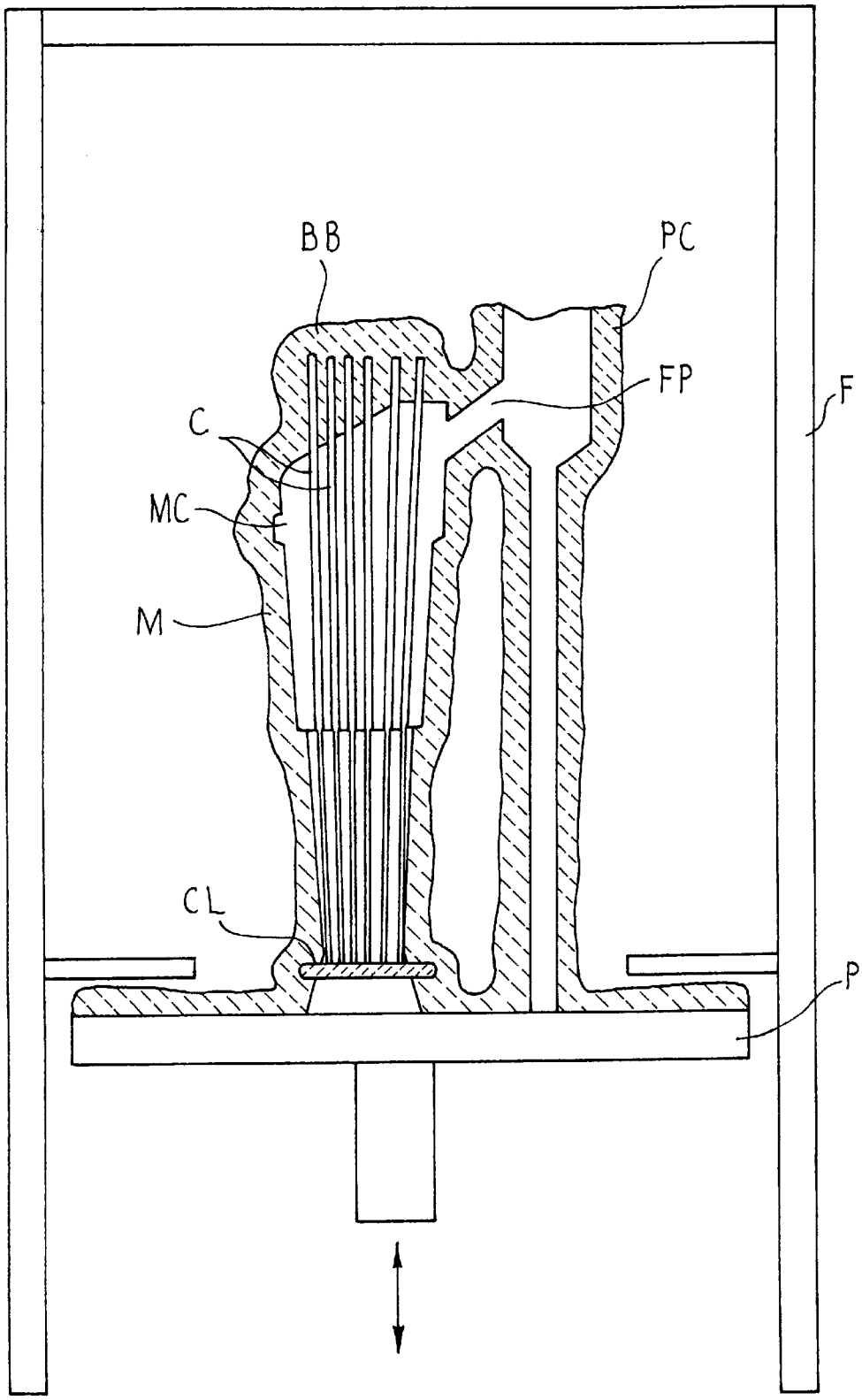

Referring to FIG. 1, carbon based reinforcement 4 is disposed in the outer tube segments or sheaths 1, 2 with the longitudinal axis of the reinforcement aligned along the longitudinal axis of the sheaths to provide strength and stiffening reinforcement at high temperatures encountered in casting a melt about the core C as disposed in an investment shell mold M in the manner illustrated, for example, in FIG. 6 for a plurality of cores C disposed in the mold cavity MC that receives the melt. The reinforcement 4 provides stiffness to maintain the shape of the quartz core tube at the high temperature of the casting operation.

The carbon based reinforcement 4 can comprise in one embodiment of the invention a carbon fiber bundle or pack comprising a plurality of high tensile strength carbon fibers or filaments. For example, a typical carbon fiber bundle can comprise 25,000 to 60,000 carbon fibers each having a diameter between 5 to 20 microns and a tensile strength betweeen 350 to 550 ksi disposed along the length or axis of the tube segments or sheaths 1, 2 through the bend B. Such a carbon fiber bundle is commercially available from Fiber Materials, Inc., Biddeford, Me. The carbon reinforcing fibers may be held together by high temperature carbon adhesive.

The inner diameters of the segments 1, 2 typically are maintained as constant as is feasible for a given casting application to provide even or uniform loading of the carbon fibers disposed in the tube passages 1*a,* 2*a.* The volume percent loading of the carbon fibers is controlled to be greater than 50%, and preferably in the range of 55% to 60%, of the passages 1*a,* 2*a* to provide the desired strength reinforcement and also thermal expansion space for the reinforcement 4 in the tube or sheath segments 1, 2 to avoid tube cracking during mold preheating. The carbon fiber bundle can be readily inserted and pulled axially into the passages defined by the prebent quartz core tube comprised of the multiple tube segments 1, 2 joined together.

Figure 4:
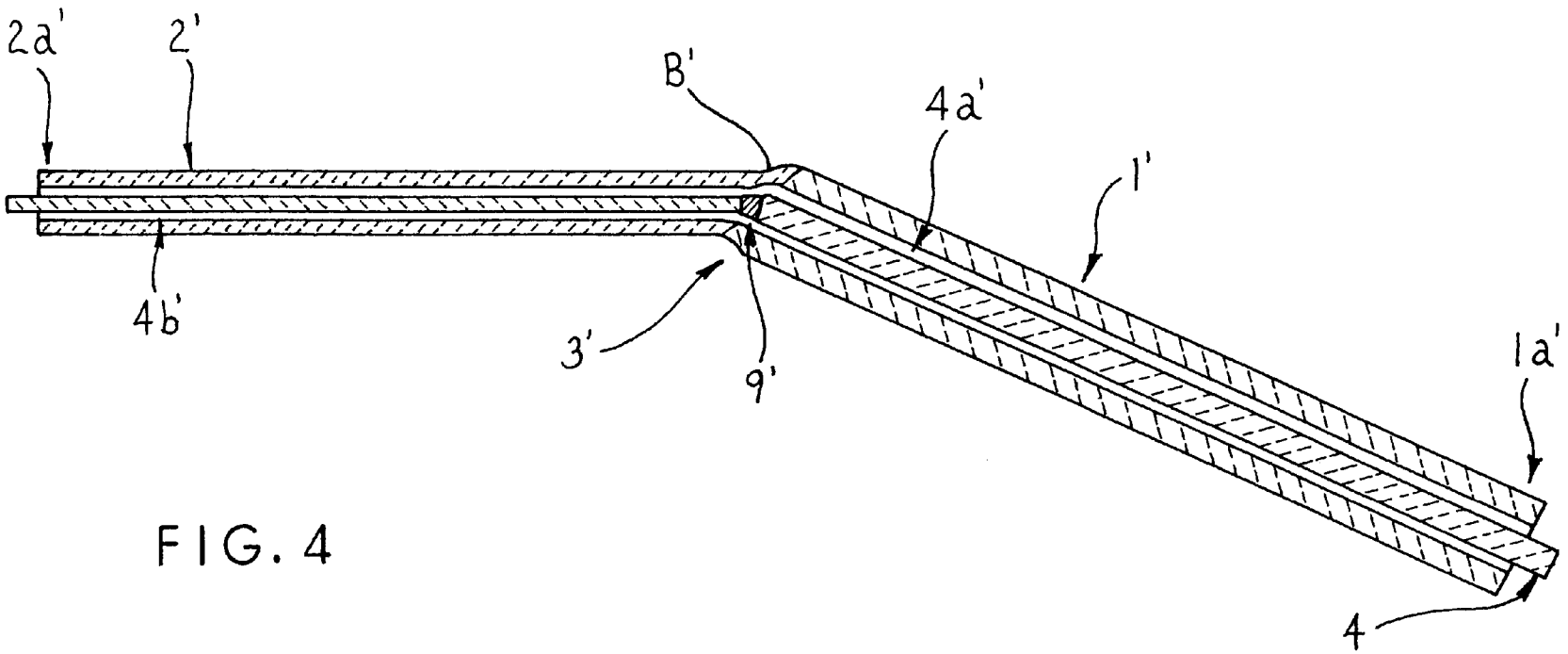

Referring to FIG. 4, an alternative embodiment of the invention involves using graphite rods 4*a′,* 4*b′* as the carbon based reinforcement 4 in lieu of the carbon fiber bundle described hereabove. In FIG. 4, a smaller diameter graphite rod 4*a′* is inserted axially into the quartz tube segment or sheath 1' through the end 1*b′* until it reaches the bend B' (junction 3' between the tube segnments 1', 2'). A small amount of carbon cement or paste 9' is injected by syringe at the bend B' (junction 3') from the opposite end of the larger diameter tube segmnent or sheath 2'. Then, a second graphite rod 4*b′* is inserted into the tube segment or sheath 2' until it contacts the carbon cement 9'. The cement 9' joins the rods 4*a′,* 4*b′* to form a completed carbon based reinforcement 4' that can expand relative to the bend B' during casting. Carbon cement or paste commercially available from Dylon Inc., Cleveland, Ohio, can be used to practice the invention.

The diameter of the graphite rods 4*a′,* 4*b′* is controlled relative to the inner diameter of the tube segments or sheaths 1', 2' to insure a relatively close fit therein and hence maintain the tube sections in orignal shape at high temperatures and yet provide enough clearance for free thermal expansion of the graphite rods in the tube segments 1', 2' to avoid cracking of the quartz tubes. To this end, a typical outer diameter of the graphite rods would be about 0.062 inch for reinforcement of a quartz tube of internal diameter of 0.066 inch. Generally, the diameter of the graphite rod(s) is varied proportionately with the inner diameter of the quartz tube(s) being reinforced. Graphite rods commercially available from Poco Graphite Decatur, Texas, can be used to practice the invention. The graphite rods themselves can be reinforced by carbon or other reinforcement fibers.

The graphite rods 4*a′,* 4*b′* can be coated with titanium carbide, silicon carbide, or other refractory carbide, oxide, nitride or other refractory compound to a thickness of 0.005 inch or so in order to impart increased stiffness to the slender graphite rods. Alternately, the graphite rods can be reacted with a suitable reactant, such as metal halides, to form a titanium carbide, silicon carbide, or other carbide outer surface region to this same end. Carbide coatings of the graphite rods are available from Advanced Ceramics, Cleveland, Ohio.

Still further, other reinforcements 4 for the tube or sheath 1 or 2 include, but are not limited to, carbon—carbon composite rods and silicon carbide rods produced from graphite rod conversion.

Induction heating of the graphite rods 4*a′,* 4*b′* during the casting operation can result in heating of the graphite rods but carbon vapor generation from the rods in the quartz tubes can be controlled by processing of the rods at considerably higher temperatures (typically in excess of 4500 degrees F.) than is used in the directional solidification or other casting operation.

Figure 5:
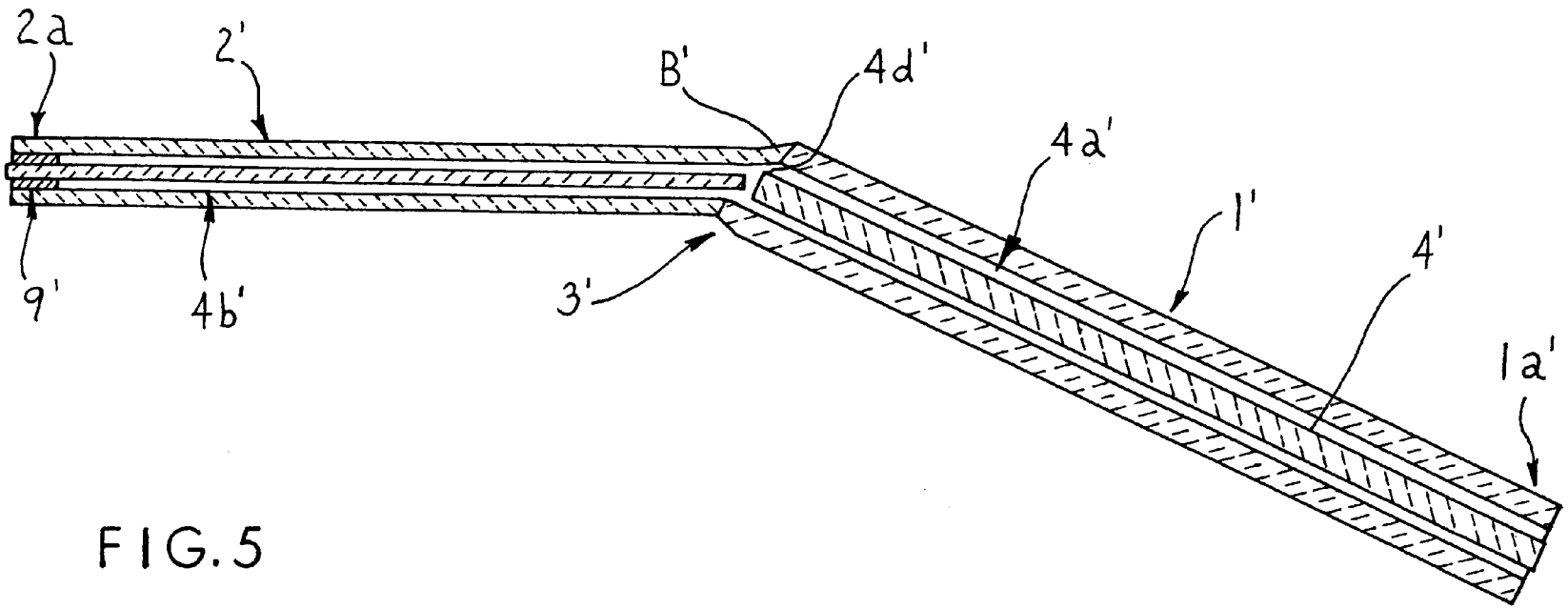

Referring to FIG. 5, an embodiment of the invention similar to that of FIG. 4 is shown schematically and differs from that of FIG. 4 in not using carbon cement or adhesive between the juxtaposed ends of the graphite rods 4*a′,* 4*b′.* Instead, in this embodiment of the invention, the graphite rod 4*a′* is glued by carbon cement 9' at the outer tip end 2*a′* of the smaller diameter quartz tube 2'. The length of the rod 4*a′* is controlled such that the inner rod end 4*c′* is located at the bend B' (junction 3'). A second graphite rod 4*b′* is inserted into the larger diameter quartz tube 2' such that the inner rod end 4*d'* rests freely against the juxtaposed end of the rod 4*a'* to form the reinforcement 4' for the tube segments or sheaths 1', 2'.

Referring to FIG. 6, a conventional ceramic investment shell mold M is partially shown positioned in a casting furnace F for producing a directionally solidified casting (columnar grain or single crystal) by the well known mold withdrawal technique wherein the mold M is placed on water cooled chill plate P which is withdrawn after filling with superalloy melt to remove heat unidirectionally from the melt. The investment shell mold M is shown including a mold cavity MC having a general turbine blade shape in which multiple elongated reinforced core tubes C of the invention described hereabove are positioned. The elongated core tubes are positioned such that their long axes extend along the long axis of the turbine blade shaped mold cavity in a manner to define respective linear cooling air passages in the solidified turbine blade casting when the cores C are subsequently removed. Non-linear (bent or arcuate) reinforced core tubes C can be used to produce non-linear or curved internal passages in the casting in lieu of linear passages that would be produced by the reinforced cores C shown.

Figure 6A:
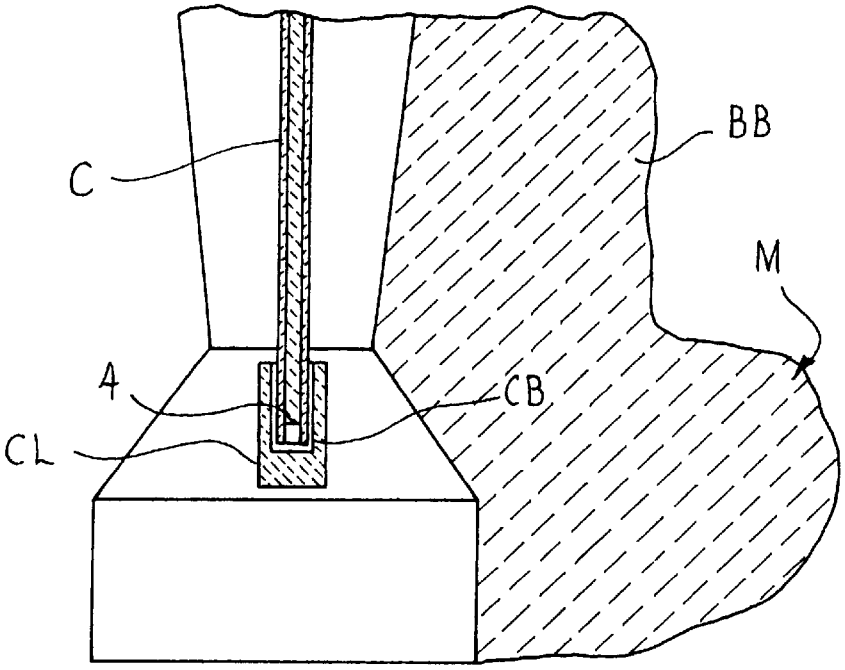

The upper sections of the core tubes C are shown having a larger diameter than the lower sections of the core tubes. The lower and upper sections of the core tubes C are fusion welded at their juncture. The core tubes C are supported in the mold cavity by having the upper ends of the core sheaths embedded in the body BB of mold M as the mold is formed by the well known "lost wax" method about a disposable (e.g. wax) pattern including the core tubes C incorporated therein as a result of the pattern being formed about the intermediate portions of the core tubes. Upper ends of the graphite rod (or fiber) reinforcement 4 that extend outside of the quartz sheaths can be embedded in the mold body BB so as to strengthen the core. The upper ends of the core sheaths may have an shallow axial surface groove or notch (not shown but see FIG. 6B) ground in the outer surface thereof to recieve mold material as the mold is formed thereabout to further lock the core tube in position. Referring to FIG. 6A, the lower smaller diameter ends of the quartz core tube sheaths are received with slip fit in respective axial counterbores CB formed in a lower ceramic core CL having lateral ends embedded in the mold body to accommodate thermal expansion differences. The lower end of the reinforcement 4 typically stops short of the lower end of the quartz core sheath so as to reside therein at the lower end.

Generally, at least one end of the core tube C is supported in the ceramic core CL for axial slip fit to allow relative axial movement and thermal expansion of the quartz core tube C and reinforcement 4 relative to one another and to the mold M during the casting process. This avoids cracking or distortion of the quartz core tubes resulting from different thermal expansion coefficients of carbon, quartz, and the ceramic mold material, which may comprise silica, zirconia, alumina, or other conventional mold materials and conventinal ceramic binder.

Figure 6B:
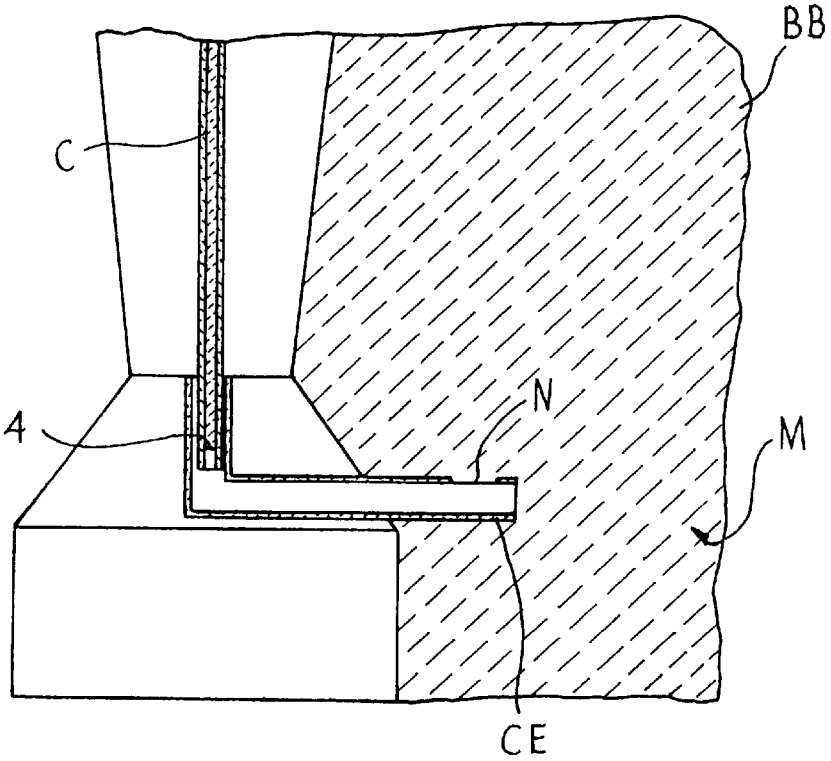

FIG. 6B illustrates a lower end of a quartz core tube sheath received to allow axial slip fit in a quartz elbow CE having a laterally extending end embedded in a ceramic mold M. The lateral end includes an axial surface groove or notch N ground into the outer surface of the quartz elbow CE partially through the wall thickness for example to recieve mold material and lock the elbow in position in the mold.

In the practice of the invention to cast a superalloy melt in the mold M, the mold M with the cores C positioned in the mold cavity MC is preheated in the induction vacuum casting furnace F to a selected casting temperature. For a typical nickel base superalloy, the mold preheat temperature would be about 2750 degrees F. To this end, the casting furnace includes induction coils (not shown) and a susceptor (not shown) of conventional type disposed about the mold M to heat the mold M. The superalloy melt heated to a selected melt superheat temperature is introduced into the mold cavity MC through the pour cup PC and feeder passages FP to fill the mold cavity and surround the cores C. The melt contacts the chill plate P for unidirectional heat removal as the melt-filled mold is withdrawn from the furnace F to produce a directionally solidified casting in each mold cavity MC in known manner.

The solidified turbine blade castings are removed from the mold M and subjected to a typical leaching treatment in a conventional caustic solution at 350 degrees F. for 20 hours to selectively dissolve the quartz tubes or sheaths of the reinforced cores C. The reinforcement 4 can be removed prior to leaching of the quartz tubes by drilling or oxidation. The extremely thin-wall thickness of the quartz tubes or sheaths of the cores C facilitates the leaching operation and reduces the time required to remove the quartz tubes. In case of carbon fiber reinforced tubes, carbon fibers are first pulled out of the tubes to facilitate leaching out of the quartz tube or sheath.

While the invention has been described hereabove in terms of specific embodiments thereof, it is not intended to be limited thereto and modifications and changes can made therein without departing from the spirit and scope of the invention as set forth in following claims.

We claim:

1. A method of casting a melt, comprising disposing an elongated reinforced core in a mold cavity, said reinforced core comprising an elongated tubular member comprising a material selected from the group consisting of quartz and silica rich material and having a passage and a carbon base reinforcement disposed in and extending along a length of said passage, introducing the melt into said mold cavity about said core, and solidifying said melt.

2. The method of claim 1 wherein said tubular member has a thin wall thickness between about 0.010 inch and about 0.015 inch.

3. The method of claim 1 wherein said carbon base reinforcement comprises primarily carbon.

4. The method of claim 1 wherein said carbon base reinforcement comprises a graphite member.

5. The method of claim 4 wherein said graphite member comprises grahite rods joined together at adjacent ends.

6. The method of claim 1 where said carbon reinforcement comprises at least one carbon fiber disposed along a length of said tubular member.

7. The method of claim 1 wherein said carbon base reinforcement includes an outer surface region comprising a carbide, nitride, or oxide.

8. The method of claim 1 wherein said melt is solidified by directional solidification to produce a columnar grain or single crystal casting.

9. The method of claim 1 including the further step of removing said core from the solidified melt forming a casting.

10. The method of claim 1 including desensitizing the tubular member by reducing stress-raising surface defects prior to disposing said core in said mold cavity.

11. A method of casting a melt, comprising disposing an elongated reinforced core in a mold cavity, said reinforced core comprising an elongated quartz tube having a passage and a carbon base reinforcement disposed in and extending along a length of said passage, introducing the melt into said mold cavity about said core, and solidifying said melt.

12. A core for use in casting a melt, comprising an elongated tubular member comprising a material selected from the group consisting of quartz and silica rich material and having a passage, and a carbon base reinforcement disposed in and extending along a length of said passage.

13. The core of claim 12 wherein said elongated tubular member includes a bend.

14. The core of claim 12 wherein said tubular member has a wall thickness between about 0.010 inch and about 0.015 inch.

15. The core of claim 12 wherein said carbon base reinforcement comprises a graphite member.

16. The core of claim 15 wherein said graphite member comprises a graphite rod.

17. The core of claim 15 wherein said graphite member comprises graphite rods joined together in end-to-end relation.

18. The core of claim 12 wherein said carbon base reinforcement comprises at least one carbon fiber disposed along a length of said tubular member.

19. The core of claim 12 wherein said carbon base reinforcement includes an outer carbide surface region.

20. The core of claim 12 wherein the outer tubular member includes an acid etched surface.

21. A core for use in casting a melt, comprising an elongated quartz tube having a passage, and a carbon base reinforcement disposed in and extending along a length of said passage.

* * * * *